US006595103B1

(12) United States Patent
Kathe

(10) Patent No.: US 6,595,103 B1
(45) Date of Patent: Jul. 22, 2003

(54) INERTIAL BREECHBLOCK GUN SYSTEM

(75) Inventor: Eric L. Kathe, Ballston Lake, NY (US)

(73) Assignee: The United States of America, as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/879,238

(22) Filed: Jun. 11, 2001

Related U.S. Application Data

(63) Continuation-in-part of application No. 09/363,700, filed on Jul. 16, 1999, now abandoned.

(51) Int. Cl.[7] ..... F41A 3/78

(52) U.S. Cl. ..... 89/198; 89/7; 89/194; 89/162; 89/177; 89/178

(58) Field of Search ..... 89/194, 195, 196, 89/197, 198, 37.14, 162, 165, 177, 178, 7

(56) References Cited

U.S. PATENT DOCUMENTS

| | | | | | |
|---|---|---|---|---|---|
| 2,184,301 | A | * | 12/1939 | Hughes | 89/14.3 |
| 3,672,255 | A | * | 6/1972 | Findlay et al. | 89/914 |
| 4,019,423 | A | * | 4/1977 | Johnson | 89/178 |
| 4,242,961 | A | * | 1/1981 | Moredock et al. | 89/14.3 |
| 4,895,064 | A | * | 1/1990 | Marzocco | 89/196 |

FOREIGN PATENT DOCUMENTS

| | | | |
|---|---|---|---|
| CH | 207 365 | * | 2/1940 |
| CH | 239 977 | * | 3/1946 |
| GB | 500922 | * | 2/1939 |

* cited by examiner

*Primary Examiner*—Stephen M. Johnson
(74) *Attorney, Agent, or Firm*—Michael C. Sachs; John F. Moran

(57) ABSTRACT

A contained Davis gun system enables misfire and hang-fire handling for fire out of battery (also known as soft recoil). The gun system decreases structural dynamic activity of the gun barrel during launch with resulting increases in system accuracy. The gun system further presents synergistic advantages when combined with a conventional recoil system in a double recoil design. The gun system includes a non-recoiling barrel and a recoil system engineered to contain a recoiling inertial breechblock capable of translating within the gun barrel. The recoil system includes a brake and a spring secured to a mount fixture. The breechblock enables the loading of the propellant and the projectile within the barrel, and further enables pressure to be contained within the barrel during firing. The recoil system applies a load to the breechblock, which is a function of the breechblock position and its velocity within the barrel. A part of the kinetic energy imparted to the breechblock is stored as potential energy within the spring, and the remaining kinetic energy is dissipated by the brake as heat. Prior to firing, the barrel and the recoil system are coupled to the firing platform. When the propellant is ignited, propellant gases generated by the propellant propel the projectile forward along the gun barrel while propelling the inertial breechblock rearward within the gun barrel.

4 Claims, 16 Drawing Sheets

INERTIAL BREECHBLOCK GUN SYSTEM

REFERENCE TO OTHER APPLICATIONS

This application is a continuation-in-part of application Ser. No. 09/363,700 filed on Jul. 16, 1999 now abandoned.

GOVERNMENTAL INTEREST

The invention described herein may be manufactured and used by or for the Government of the United States for governmental purposes.

FIELD OF THE INVENTION

This invention generally relates to the field of ballistics, and it particularly relates to recoilless gun systems such as the "Davis gun" system described in U.S. Pat. No. 1,108,714. More specifically, the present invention relates to a contained Davis gun system that enables misfire and hang-fire handling for fire out of battery, that decreases structural dynamic activity of the gun barrel during launch with resulting increases in system accuracy, that possesses an almost infinitely variable chamber volume and a potential for direct fire "zoning", with a reduced system weight, and that presents synergistic advantages when combined with a conventional recoil system in a double recoil design.

BACKGROUND OF THE INVENTION

A "Davis gun" system is known where the propellant gas pressure is inertially contained. A projectile is fired toward the front and a compensating mass toward the rear from an equal-caliber barrel open on both ends. The axial forces are transmitted to the gun only by friction of the projectile and/or the compensating mass on the inner wall of the barrel; propellant gas forces in this case do not contribute toward recoil during firing, and the friction forces can be kept lower by several orders of magnitude than the propellant gas forces, while the friction forces of the projectile and of the compensating mass, at least in part, compensate each other. For this reason, the so-called "Davis gun" is an essentially recoilless gun.

Conventional gun systems still present some or all of the following concerns and none provided an integral, fully satisfactory solution to such concerns.

Conventional gun systems are awkward to operate in the fire out of battery mode. Fire out of battery is a technique to reduce the magnitude of the forces applied between the gun mount/platform and those parts of the gun that recoil during firing. It is achieved by pre-accelerating the recoiling gun mass forward, prior to firing. Thus, upon firing, the rearward momentum applied to the recoiling gun parts by the containment of the propellant gas pressure is directly offset by that portion imparted to the gun prior to firing. Theoretically, since half of the momentum may be applied prior to firing, the maximum speed of recoil may be cut exactly in half. Since the kinetic energy is related to the square of velocity and is achieved by the recoil forces applied over the available recoil stroke, the recoil forces may be theoretically cut by a factor of four. Conservation of momentum is achieved by increasing the duration of the recoil forces, again by a factor of four.

Two principal engineering challenges hinder the application of fire out of battery to conventional gun systems. First, in the event of a misfire, the forward momentum of the pre-accelerated recoiling gun parts is not reversed by the reaction of the gun to firing the projectile forward. As a consequence, the forward momentum and its associated kinetic energy must be extracted in a controlled fashion to prevent damage resulting from the impact of the gun against the gun mount as it reaches the end of the available recoil travel stroke. This requires a shock isolator termed a misfire snubber. Since fire out of battery is applied principally to attenuate the recoil forces (or reduce the required recoil stroke), the magnitude of the snubber loads are also generally limited. In the event the snubber loads are required not to exceed the same maximum loads as the pre-acceleration loads, it may be seen that kinetic energy imparted to the gun over the intended recoil stroke prior to firing will require exactly the same stroke length to safely decelerate the gun to a standstill in the event of a misfire. Thus half of the total available recoil stroke would have to be dedicated to misfire snubbing. Since the same kinetic energy is required to pre-accelerate to half of the forward momentum regardless of how misfire is addressed, it may be seen that under the assumptions made, the maximum recoil forces must be doubled relative to those of the theoretical minimum. Thus, relative to the standard fire in battery mode, the fire out of battery mode that incorporates such a misfire snubber may only cut recoil loads by a factor of two.

The second principal challenge that hinders the application of fire out of battery to conventional gun systems is hang fire. Hang fire is the delayed ignition of a round of ammunition and is relatively rare. The extreme situation of hang fire for a fire out of battery gun system would be the delay of shot start ignition until after the misfire snubber had brought the forward momentum of the gun system to rest; thus, in this context, a misfire is a necessary prerequisite to a hang fire, but only a few misfires become hang fires. When such a hang fire occurs, no forward momentum remains to offset the rearward momentum imparted to the gun system by its reaction to firing. Therefore, the recoiling gun mass may recoil with double the speed of the ideal fire out of battery design, and thus four times the kinetic energy. This dramatic increase in kinetic energy must be extracted using the integral of recoil force over recoil stroke. It is obvious that design of a conventional gun system to withstand hang fire is the exact same problem as the conventional fire in battery mode of operation, thus negating much of the impetuous for incorporating a fire out of battery design in the first place.

"Gun whip," that is the motion of a gun barrel during in bore gun dynamics, can become excessive when the gun barrel itself recoils. This recoil acceleration of a traditional barrel is a significant contributor to the gun barrel dynamic flexure that results in increased round dispersion. In addition, the ability to increase the structural stability of conventional gun systems using external "truss like" structures to increase the flexural rigidity of the launch tube is hindered by concerns about the effects of recoil upon such structures. Furthermore, in the absence of such external structures high emphasis is placed upon the flexural rigidity of the gun barrel itself, therefore, the application of non-homogeneous manufacturing techniques, such as composite or wire wrapped guns are impeded.

The required flexural rigidity of Conventional gun systems impairs "fine tune" stabilization capability for enabling the gun muzzle to bend to the target. In the absence of recoil acceleration, most of the remaining gun dynamic loads associated with launch including centripetal acceleration of the projectile and gases increase as a function of the non-ideal curvature of the centerline of the gun barrel and the projectile velocity which is quite low near the breechblock end.

Conventional gun systems employ the integrity of steel to contain the rearward reaction force of the gun launch created by the internal pressures applied over the exposed breechblock area using stress developed as the breechblock material undergoes strain. They require a breech ring, breechblock, and threads applied to the rear of the gun barrel to contain the rearward force of the high pressure propellant gases, thus increasing the ultimate weight of the gun system.

Numerous attempts were proposed to address the foregoing concerns. One such attempt that aims at reducing the recoil forces associated with the reaction of a recoiling gun to firing is to increase the recoil stroke. Compared with the theoretical limit of implementation of the current invention, increasing the recoil stroke of any gun system by a factor of four may reduce the recoil force by a factor of four. Long recoil strokes are undesirable for a number of reasons for most applications. First, the longer the recoil stroke the more substantial and complicated the gun mount becomes. For turreted gun systems, the need to be able to point the gun at different elevations and azimuthal orientations results in a spherical sweep volume that increases with the cube of the distance between the furthest extent of recoil and the trunnion bearings. This sweep volume is very wasteful and requires substantial armor to protect.

Some gun systems apply muzzle brakes to reduce the forward momentum imparted to the propellant gases. These function by redirecting the gas flow velocity vector so the forward component is reduced, or even reversed if the muzzle brake bends the gas flow by more than 90 degrees. One of the preferred embodiments of the current invention is fully compatible with muzzle brakes.

A recoilless gun, such as the M40AD 106 mm recoilless rifle, is a gun system that achieves a momentum balance by ejecting high velocity propellant gases in a direction opposite to the projectile launch. In analogy, the "Davis gun" launches momentum carrying inertia (manifest as a projectile composed of lead shot) rearward without recapturing the inertia for later use.

However, these attempts were not completely successful in addressing and resolving all the foregoing design concerns. For a Davis gun that shoots a dummy projectile rearward in addition to the ordnance projectile that is fired forward, all the energy applied to the rearward projectile is wasted in the sense that it is not applied to defeat a target. The higher this mass, the less energy is required to balance the momentum. However, the higher this mass, the greater the logistical burden to supply the ammunition to the field. A Davis gun barrel must contain the pressure of the propellant gases. Since the dummy mass slides rearward, additional requirements (i.e., weight) will be required to contain these gases over the rearward stroke.

A recoilless gun expends significant propellant energy sending the high velocity and lightweight propellant gases rearward. In addition, a recoilless rifle also needs to vent these gases rearward, and must overhang the end of the fighting vehicle to which it is mounted. This is a burden for reloading the guns. The nozzle design requirements and high energy gases limit the operating pressure of recoilless guns.

SUMMARY OF THE INVENTION

It is an object of the present invention to address and satisfactorily resolve the above concerns, and to provide a gun system that enables misfire and hang-fire handling for fire out of battery, that decreases structural dynamic activity of the gun barrel during launch with resulting increases in system accuracy with a reduced system weight, and that presents synergistic advantages when combined with a conventional recoil system that may incorporates a muzzle brake in a double recoil design.

The present invention enables the use of the intended launch stroke to provide a sufficiently long misfire snubber that would subsequently allow sufficient snubber stroke to contain a hang fire without excessive recoil force. In other terms, in the event that a round of ammunition misfires, the round and the inertial breechblock are free to travel down the prismatic bore of the gun as they are decelerated. The deceleration trajectory may be designed such that the combined stroke available between the intended recoil stroke and that traversed by the misfire snubber is sufficient to extract the kinetic energy imparted to the inertial breechblock upon a hang fire with out exceeding the design recoil force limits. In the event of such a hang fire, the interior ballistics travel of the projectile would be cut short from the intended bore travel by the snubber stroke.

The present invention further enables the forward ejection of any round that is no longer deemed a viable round for any reason. For example, the breechblock need not be opened following a misfire. The round may merely be ejected out of the muzzle. Similarly, the gun barrel may be used as the reload port to upload rounds from an external resupply source.

The foregoing and additional features of the present invention are realized by a gun system that includes a non-recoiling barrel and a recoil system secured to the barrel or the firing platform. The recoil system includes a brake and a spring secured to a mount fixture. The gun system further includes an inertial breechblock housed within the barrel, and capable of translating within the barrel. The breechblock enables the loading of the propellant and the projectile within the barrel, and further enables pressure to be contained within the barrel during firing. The recoil system applies a load to the inertial breechblock, which is a function of the breechblock position and its velocity within the barrel. A part of the kinetic energy imparted to the breechblock by the gun system reaction to firing is stored as potential energy within the spring, and any remaining kinetic energy is dissipated by the brake as heat.

Prior to firing, the barrel and the recoil system are coupled to the firing platform. When the propellant is ignited, propellant gases generated by the propellant propel the projectile forward along the gun barrel while propelling the inertial breechblock rearward with compensating momentum. At shot exit, when the projectile exits the barrel, the breechblock begins to engage the recoil system. The rearward free recoil deflection of the breechblock that occurs prior to shot exit and engagement of the inertial breechblock with the recoil system may be computed by dividing the sum of deflection and mass products for the projectile and propellant gases by the mass of the breechblock. After the shot exit the breechblock is decelerated by the recoil system.

According to another embodiment, the gun barrel and the recoil system are coupled to the firing platform, and the projectile and the breechblock are pre-accelerated forward by the recoil system prior to the ignition of the propellant.

Upon firing the projectile, the reaction of the breechblock is manifest as a rearward velocity and subsequent kinetic energy. The goal of the recoil system is to design it such that the kinetic energy of the reversed breechblock is equal to the kinetic energy that the recoil system imparts to the breechblock and to the projectile prior to firing. The propellant is ignited upon reaching a predetermined firing location and velocity selected to minimize a load required by the recoil system load over a recoil stroke for both a pre acceleration stroke and a deceleration stroke. Just prior to, and after shot start, the breechblock continues to slide forward some distance until its momentum is reversed by the force of the propellant gases. Shortly after shot exit, during the containment of the recoiling breechblock, the kinetic energy of the breechblock following the shot exit is converted into potential energy of the recoil system spring.

According to still another embodiment, the gun barrel begins to move rearward as soon as the breechblock is released and pre-accelerated forward, and the recoil system includes primary and secondary recoil systems. Prior to firing, a load between the barrel and the breechblock is decoupled from a platform by the secondary recoil system. The secondary recoil system is attached to the platform, and may include a muzzle brake that redirects the flow velocity of a portion of the propellant gases rearward after shot exit, which would result in a large forward load applied to the barrel at the muzzle brake.

The gun systems of the present invention offer several advantages, some of which are listed below.

1. Fire out of battery, also known as "soft recoil", is facilitated by three properties:

1.A. In the event of a misfire, the entire travel length of the gun barrel is available for deceleration of the forward momentum of the combined inertial breechblock and round. Misfire handling is a principle disadvantage of fire out of battery and is solved using a contained Davis gun system of the present invention. In a Davis gun system, the rearward projectile is expelled from the gun system. According to the present, the rearward projectile is not expelled, but is rather captured or contained by the recoil system, wherefore, the designation "contained Davis gun system".

1.B. In the event that a round has misfired, or is no longer deemed a viable round for any reason, it may be ejected out of the muzzle of the barrel (e.g. pneumatic ejection). The present contained Davis gun systems eliminate the chamber geometry that prevents the forward ejection of "bad" rounds.

1.C. In the event that a round experiences hang-fire, the momentum may be extracted by the recoil system over the combined stroke of the misfire snubber and intended recoil stroke, thus keeping forces low. The misfire snubber stroke is sufficiently long to enable tolerable recoil forces to be applied.

2. "Gun Whip", that is the motion of a gun barrel during in bore cannon dynamics is greatly reduced as the cannon barrel itself no longer recoils. This recoil acceleration of a traditional barrel is a significant contributor to the gun barrel dynamic flexure that results in increased round dispersion. This is particularly true of gun barrels that are pre-accelerated forward to effect fire out of battery and are thus vibrationally disturbed by these forces prior to firing.

Gun whip may also be reduced by the ability to structurally stabilize the cannon using external "truss like" structures to increase the flexural rigidity of the launch tube without concerns about the effects of recoil acceleration upon such structures.

With the decreased emphasis placed upon the flexural rigidity of the cannon barrel itself, non-homogeneous manufacturing techniques, such as composite or wire wrapped guns may become more viable. Similarly, with the decoupling of the cannon barrel mass from the recoiling gun system mass, lightweight cannon manufacturing materials may become more viable.

3. Smart structure technology, using sensors, actuators, and control mechanisms, is also facilitated by the removal of the gun barrel from the shock and vibration environment of recoil. This enables simplified application of sensors and actuators to the structure. Smart structure technology is also facilitated by the decreased flexural rigidity of gun barrels making active bending of the barrels easier for the actuators.

4. Gun barrels manufactured of non-homogenious materials, such as the wire wraped gun, that are facilitated by the present invention are easier to bend into desired shapes, thus increasing the controllability of the gun systems enabled by the present invention. A "line tune" stabilization could be applied to the muzzle end of the gun barrel, literally bending the gun muzzle to the target. An important consideration of such a stabilization technique for a conventional gun system would be the "gun whip" described herein.

In the absence of recoil acceleration, most of the remaining gun dynamic loads associate with launch including centripetal acceleration of the projectile and gases increase as a function of the non-ideal curvature of the centerline of the gun barrel and the projectile velocity. Therefore, intentional flexure induced near to the breechblock of the gun barrel where the round velocity is slow, will not result in large dynamic loads and subsequently launcher flexure and dispersion.

5. The ultimate weight of a gun system may be reduced. The present invention uses inertial containment of the propellant gas pressure. Conventional gun systems use the integrity of steel to contain the pressure using stress developed as the material undergoes strain. Inertial containment obviates the need for a breech ring, conventional breechblock, and threads applied to the rear of the gun barrel.

It is very possible that the inertia used to contain the propellant gas pressure could serve a dual use. For example, the inertial breechblock could be directly coupled to the rear armor plate of an oscillating turret. Thus, the mass of the armor would directly reduce the recoil energy without requiring additional system burden.

With reduced emphasis placed upon flexural rigidity, the application of lightweight composite materials to reduce launcher mass is facilitated.

By enabling fire out of battery, less emphasis will be placed upon maintaining a large recoiling inertia of the gun system. By conservation of momentum a large recoiling mass reduces the kinetic energy imparted to the gun system. The relationship is inversely proportional; e.g., if the recoiling mass were doubled, the energy is cut by a factor of two. Using simple physical models, an idealized fire out of battery gun system may reduce the kinetic energy by a factor of four with respect to its fire in battery counterpart. Thus, far less system mass is required to maintain kinetic energy levels of the recoiling gun system at manageable levels.

7. The contained gun systems of the present invention may be combined with a conventional recoil by employing a double recoil system. Using this approach, the benefits of fire out of battery may be realized using the present inventive technology, while the recoil energy imparted to the gun system by conservation of momentum may be reduced by leveraging the inertia of the entire barrel.

A double recoil system would also enable muzzle brakes to be applied to the cannon barrel while isolating the resulting shock load from the weapon platform using a secondary (gun barrel) recoil system.

BRIEF DESCRIPTION OF THE DRAWINGS

The above and other features of the present invention and the manner of attaining them, will become apparent, and the invention itself will be best understood, by reference to the following description and the accompanying drawings, wherein.

Similar numerals refer to similar elements in the drawings. It should be understood that the sizes of the different components in the figures are not necessarily in exact proportion or to scale, and are shown for visual clarity and for the purpose of explanation.

DETAILED DESCRIPTION OF PREFERRED EMBODIMENTS

Figure 1A:
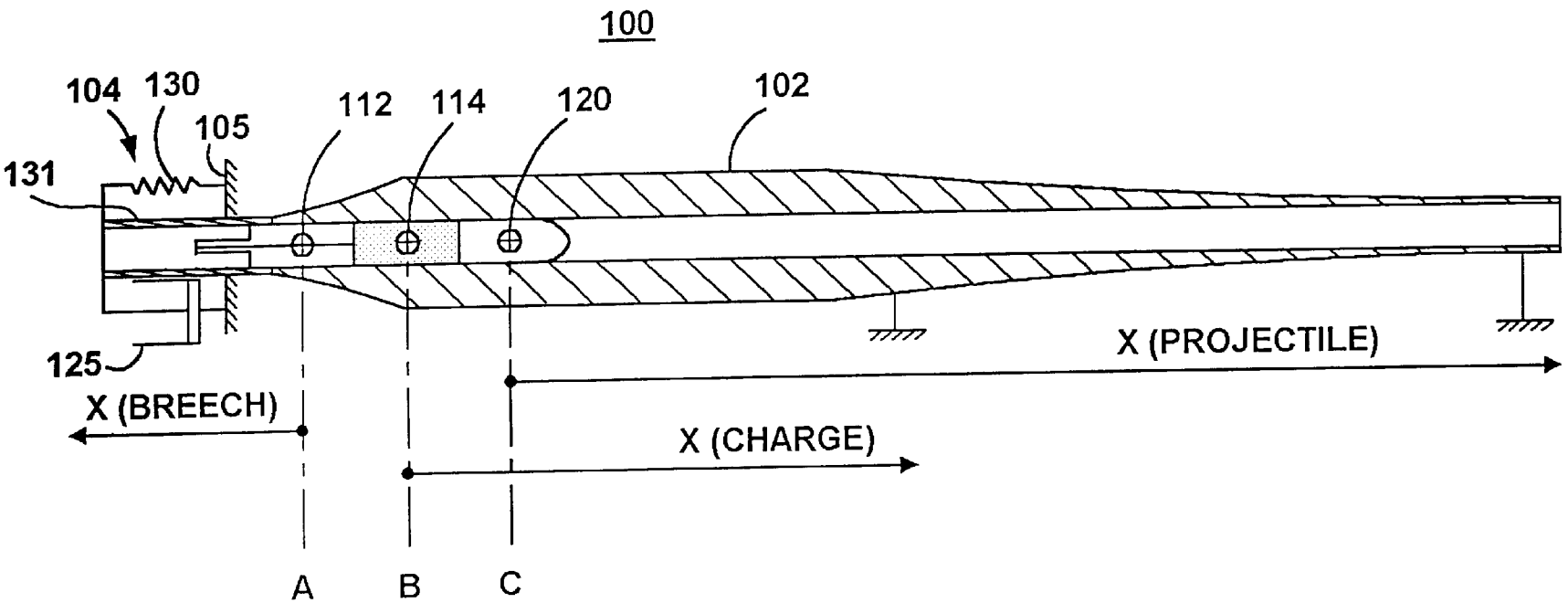
FIGS. 1A, B, C and D are schematic, cross-sectional, side elevational view of an inertial breechblock gun system according to the present invention, illustrating its operation during traditional fire in battery launch.

FIGS. 1A through 1D illustrate an inertial breechblock gun system 100 according to the present invention, during fire in battery launch. The gun system 100 includes a non-recoiling barrel 102 secured to a recoil system 104, which, in turn, is secured to a mount fixture 105. The gun system 100 further includes an inertial breechblock 112, a propellant 114, and a launch mass or projectile 120 that are housed within, and capable of translating within the barrel 102. The centers of mass of the inertial breechblock 112, the propellant 114, and the launch mass 120 are illustrated by three circles.

The breechblock 112 enables the propellant 114 and the projectile 120 to be loaded in the barrel 102, and further enables the pressure within the barrel 102 to be contained during firing. The breechblock 112 can be a "Davis mass" and serves two functions. First, the mass of the inertial breechblock 112 contains the propellant pressure by its very resistance to motion using Newton's Second law which is commonly known as F=ma where F is force, m is inertia, and a is acceleration. As a result of the inertial containment of the propellant gas pressure, the inertial breechblock 112 accumulates significant rearward velocity which results in the second function of the breechblock 112, namely to seal the propellant gas pressure as it slides rearward.

The mount fixture 105 exemplifies a means by which the gun system 100 is coupled to a gun platform, such as a helicopter, a tank and so forth. The mount fixture 105 further enables the gun barrel 102 to recoil within it during firing, and repositions the gun barrel 102 after firing. The mount fixture 105 controls the cantilevered length of the gun system 100, and affects the fundamental resonance frequency of the barrel 102.

The gun barrel 102 contains the propellant gas pressure, and further constrains the round of ammunition to follow a desired trajectory while imparting kinetic energy to the round. The recoil system 104 is shown as including brakes 125 and recuperator springs 130. While a conventional recoiling gun barrel 102 accelerates rearward during launch, the gun barrel 102 depicted in FIGS. 1A through 1D does not recoil and may remain motionless during operation. It is worthwhile noting that since the inertial breechblock 112 continues to slide rearward after shot exit and "blow down", the rear of the gun barrel 102 needs only act as a mechanical guide and does not need to contain pressure. As used herein, "blow down" is a term used to describe the ejection of the propellant gases that immediately follows shot exit. The "blow down" dynamic commonly imparts as much as 20 percent of the overall recoil momentum to the gun system.

The propellant 114 contains the chemical energy released during combustion. Upon ignition, the propellant 114 is converted to a gaseous state and travels down the bore of the gun barrel 112 behind the projectile 120. Most current propellants are solid prior to ignition although both liquid and gaseous propellants can be used. Assuming for simplicity that the propellant (114) gas density is constant (though variations do exist) the center of mass of the propellant gases 114 travel, has the velocity as the projectile 120 until shot exit. After shot exit, the propellant gases 114 are expelled out of the muzzle of the gun barrel 102 during the "blow-down" period.

The launch mass 120 is the projectile which is projected from the muzzle of the gun barrel 102. For the interior ballistics, the projectile 120 can include a warhead and any supporting structure required to interface the intended warhead to the gun barrel 102, and to contain the propellant gas pressure.

The recoil system 104 applies loads to the recoiling breechblock 112 as a function of the breechblock 112 position and velocity, Some of the kinetic energy imparted to the breechblock 112 by the momentum balances with the out-going projectile 120 is stored as potential energy within the recoil springs 130, the remainder is dissipated by the recoil brakes 125 which converts the energy to heat. The kinetic energy imparted to the breechblock 112 is exactly nullified by the integral of recoil force over the recoil stroke by the conservation of energy.

FIG. 1A illustrates the gun system 100 prior to firing. The gun system 100 is fixed to ground, and the recoil system 104 is coupled directly to ground as well.

Figure 1B:
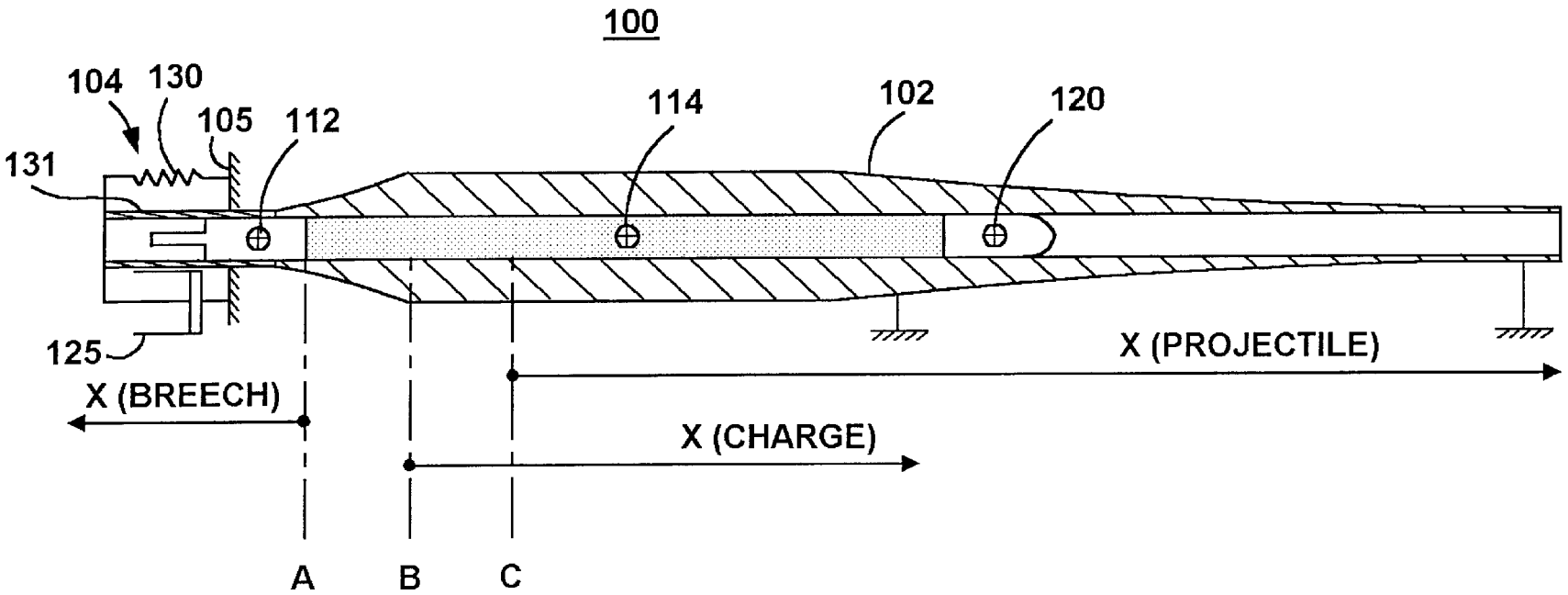

FIG. 1B illustrates the gun system 100 just, or shortly after the propellant 114 is ignited. The propellant gases propel the projectile 120 forward, along the bore of the gun barrel 102. As an optional feature, the recoil system 104 which contains the recoiling breechblock 112 is not activated until the shot exit has occurred. Thus, the breechblock 112 is free to recoil unimpeded during the in-bore dynamics. Since only internal loads are acting upon the three moving parts (the inertial breechblock 112, the propellant or propellant gases 114, and the launch mass or projectile 120), the center of mass of the combined gun system 100 must remain constant. It is worthwhile to note that this analysis neglects the small effect of the ambient gases forward of the projectile 120 which result in slightly greater forward momentum.

Figure 1C:
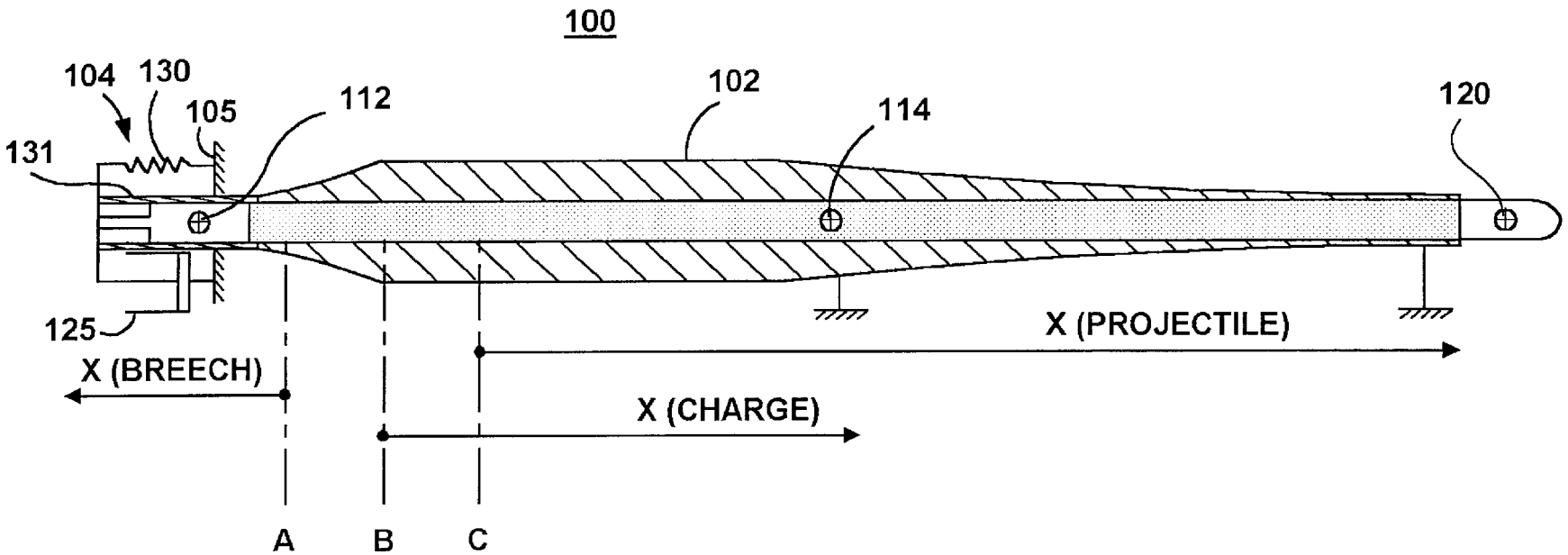

FIG. 1C illustrates the gun system 100 at shot exit, when the projectile 120 exits the barrel 102. The inertial breechblock 112 just begins to engage the recoil system 104. At this instant in time, the free recoil deflection of the breechblock 112 may be computed by dividing the sum of deflection and mass products for the launch mass 120 and propellant gases 114 by the mass of the inertial breechblock 112. For example, a 500 Kg inertial breechblock 112 with a 10 Kg launch mass 120 that travels 2.6 meters along a 5 meter long gun barrel 102 (approximately half the projectile travel due to the barrel chamber geometry) with a 10 Kg propellant mass, would result in a free recoil stroke of 15.2 centimeters. Some additional rearward momentum will be applied to the inertial breechblock 112 by the "blow down" of the propellant gases 114 after shot exit.

Figure 1D:
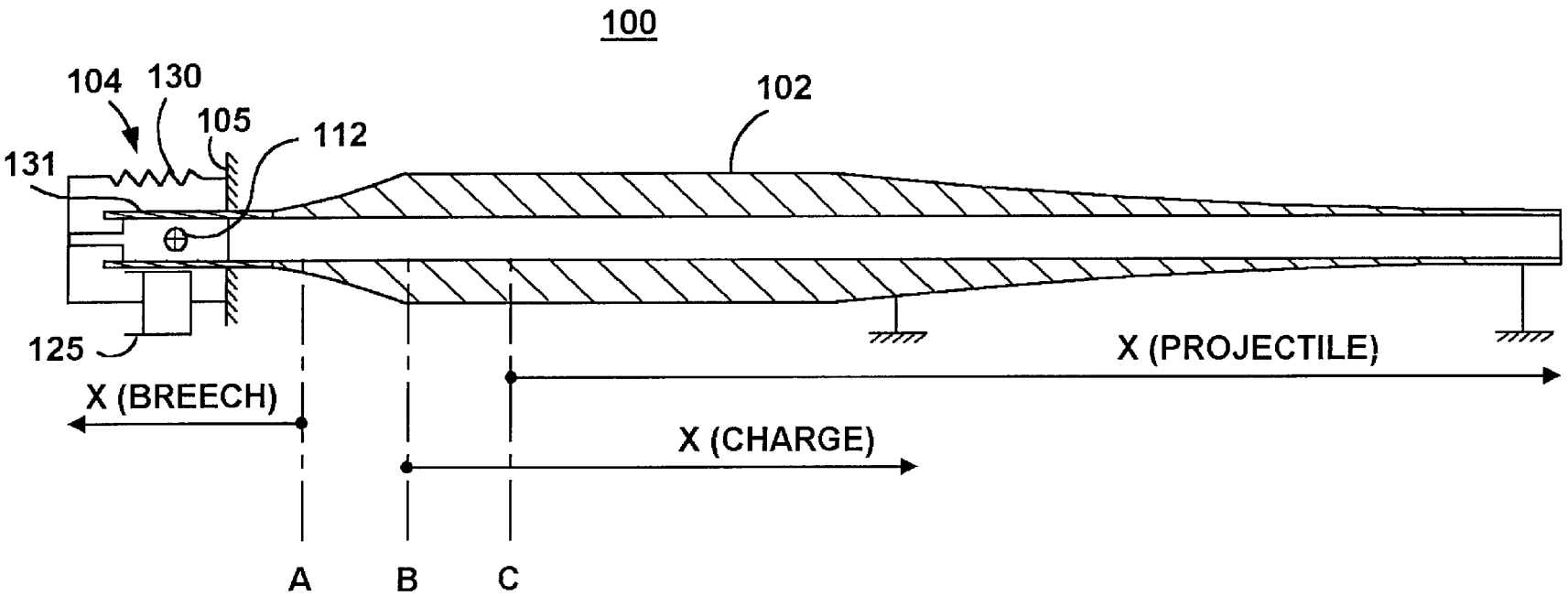

FIG. 1D illustrates the gun system 100 after the shot exit, during the containment of the recoiling breechblock 112. After the projectile 120 exits the inertial breechblock 112 it is decelerated by the recoil system 104 in analogy with the deceleration of a conventional recoiling gun. The pressure containment requirements of the gun barrel 102 are eliminated shortly after the shot exit. The rearward region 131 of the gun system 100 is not required to maintain hoop integrity because of the lack of exposure to substantial propellant pressure, and may be used to interface an autoloader to the gun bore or to meet other system requirements.

The present embodiment presents several advantages some of which are listed below. Using an inertial breechblock, pressure containment requirements are achieved through the engineered deflection of a freely recoiling mass as opposed the structural containment achieved through a closed breechblock. This saves the weight that would be required for a breechblock ring and lug system that would be required to maintain structural integrity during pressure containment.

Many of the applications of the inertial breechblock containment do not require the gun barrel 102 to move during operation. This significantly reduces the structural dynamic loads that cause gun barrel flexure during launch and might otherwise reduce system accuracy and performance. This also enables new technology to more easily adapt or control the structure for improved performance and or reduced system weight.

As a consequence of the prismatic bore, bad or defective rounds, for example those that did not ignite, may be ejected forward and out of the muzzle. This may be achieved using any appropriate available technique such as a pneumatic expulsion system.

FIGS. 2A through 2F illustrate the operation of an inertial breechblock gun system 200 during fire out of battery launch. The breechblock 112 is allowed to freely recoil rearward while the projectile 120 is launched forward.

Figure 2A:
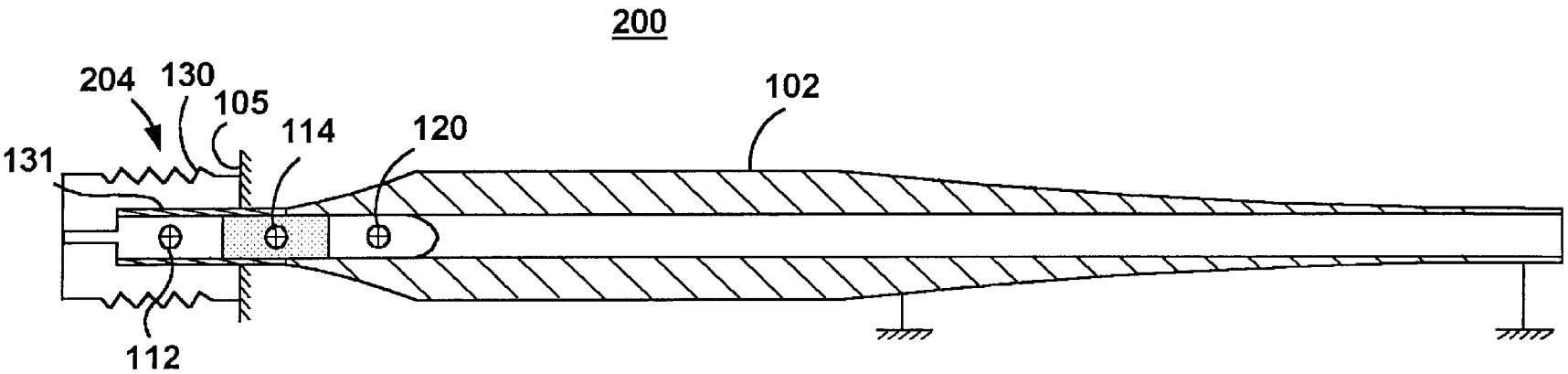
FIGS. 2A, B, C, D, E and F are schematic, cross-sectional, side elevational view of an inertial breechblock gun system of the present invention, illustrating its operation during fire out of battery launch.

FIG. 2A illustrates the gun system 200 prior to firing. The gun system 200 is fixed to ground, and the recoil system 204 is coupled directly to ground as well. For the fire out of battery, the projectile 120 is coupled to the inertial breechblock 112. Together, both are pre-accelerated forward by the recoil system 204. The recoil system 204 could be achieved with only springs, although a robust recoil system would require some braking or other control measures to handle uncertainty and disturbance loads.

The recoil system 204 distinguishes the gun system 200 over the gun system 100. The purpose of this recoil system 204 is to pre-accelerate both the inertial breechblock 112 and the projectile 120 forward prior to ignition of the propellant 114. This forward momentum directly reduces the rearward momentum that will result within the inertial breechblock 112 during the launch loads. In an ideal situation such a recoil system 204 would convert potential energy stored in the preloaded springs 130 (depicted in tension) into the kinetic energy of the inertial breechblock 112 and the projectile 120.

Upon firing the projectile 120, the kinetic energy of the recoiling inertial breechblock 112 will be exactly equal to the kinetic energy that the recoil system 204 imparted to the breechblock 112 and the projectile 120 prior to firing. Thus, the kinetic energy of the recoiling breechblock 112 would be exactly converted back into the potential energy of the springs 130, thus conserving the energy for the next projectile 120 with no energy dissipation. Since the net mass on of the forward stroke is higher than the return stroke, the forward speed would be less than the return speed. It is also worthy to note that an ideal spring 130 would be highly preloaded and very soft, so as to result in a nearly constant applied load throughout the duration of the firing and recoiling event.

The gun barrel 102 may be more weight efficient than its fire in battery counterpart shown in FIGS. 1A through 1D. The reason is that the inertial breechblock 112 does not necessarily deflect rearward from its position at shot ignition. Instead, it continues forward due to its momentum until its forward velocity is reversed by the rearward load of the pressure over its front area. At the instant in time that the propellant gas pressure is vented, the breechblock 112 may be very near to its position at the shot ignition. Thus, the gun barrel 102 behind the furthest rearward reach of the propellant gas pressure does not need to be designed with the mechanical integrity required to contain the propellant gases, that is less gun barrel 102 is wasted containing gas pressure over the rearward stroke of the inertial breechblock 112.

Figure 2B:
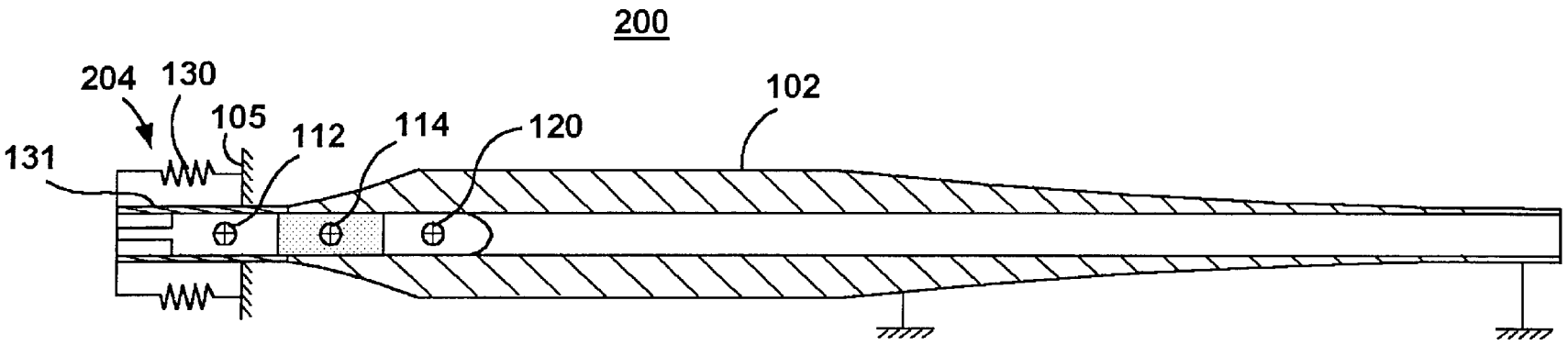

As shown in FIG. 2B, the propellant 114 is ignited upon reaching a predetermined firing location and velocity selected to minimize the required recoil system 204 (spring) load over a recoil stroke for both the pre acceleration and deceleration strokes. In other terms, with a slight approximation, the goal is to balance the in-going kinetic energy of the coupled projectile 120 and Davis mass or inertial breechblock to equal the return kinetic energy of the breechblock 112.

Figure 2C:
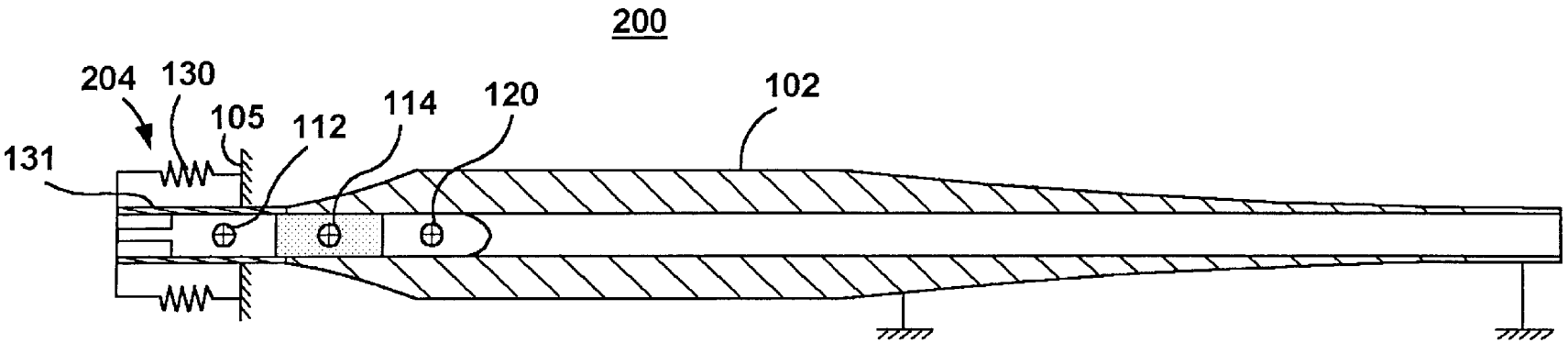
Figure 2D:
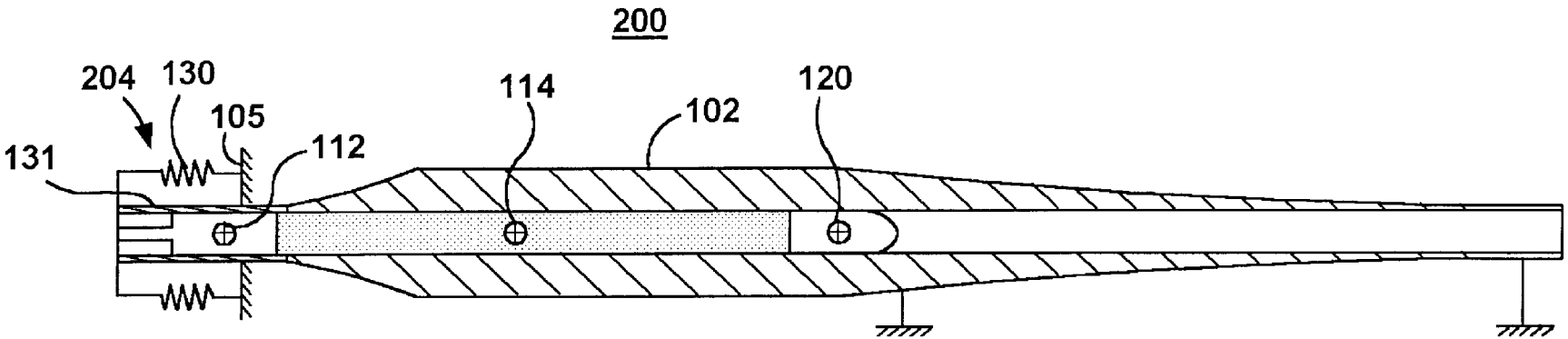

FIGS. 2C and 2D illustrate the states of the gun system 200 just prior to, and after shot start, respectively. The breechblock 112 continues to slide forward some short distance until its momentum is reversed by the propellant gas 114 pressure applied against its forward area (FIG. 2D).

Figure 2E:
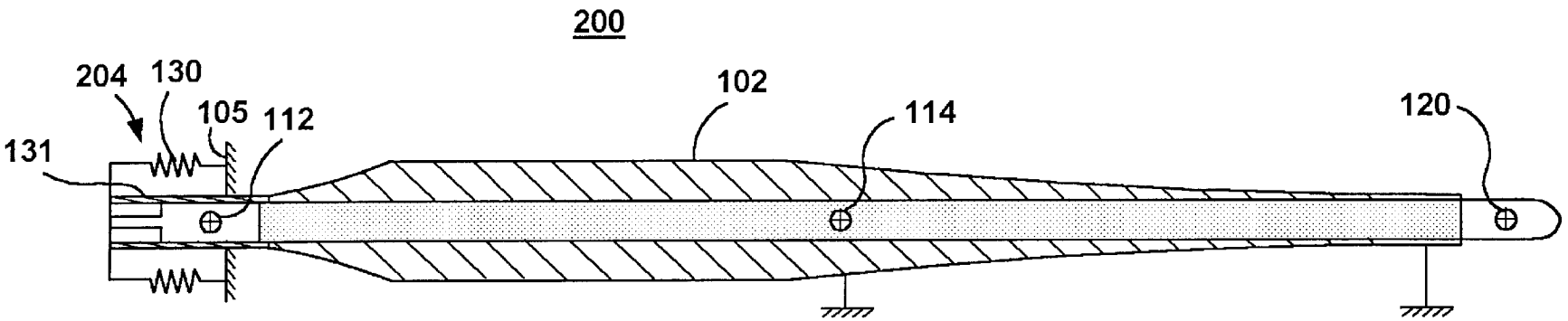

FIG. 2E illustrates the state of the gun system 200 shortly after shot exit. The pressure containment requirements of the gun barrel 102 are eliminated. This has the potential to save weight. As in the extreme case of a Davis gun, the rearward portion of the barrel through which the Davis mass (i.e., inertial breechblock slides) must contain the high propellant gas pressures of launch. In the classic case of a Davis gun, the entire rear half of the barrel 102 must essentially be the mirror image of the front half because the two projectiles weigh the same. With the present invention, if the rear projectile weighs twice as much as the front projectile, only one third of the cannon barrel 102 is dedicated to pressure containment for the Davis mass for the fire in battery mode of operation, and virtually none of the cannon barrel 102 is dedicated to pressure containment for the Davis mass for the ideal fire out of battery mode of operation.

In addition, in order not to excite the gun vibration until after shot exit, two regions guide the Davis mass in the present embodiment. The first region contains the gas pressure and the second region is not traversed until the ordnance projectile has been released, uncorking the pressure in the gun system. Therefore, the second region does not need to contain high gas pressure. Indeed, the rear barrel section may optionally be perforated or sectioned to facilitate autoloading.

For the present fire out of battery contained Davis gun system, the Davis mass may be pre-accelerated with enough velocity that it continues forward some distance until its momentum is reversed by the pressure of the propellant gases. Thereafter, upon recoiling rearward just reaches the axial position at which it was when the shot ignited. In other terms, no pressure containment is required behind the position where the shot started. Thus, behind this position, the gun barrel need only guide the Davis mass during its deceleration and does not need to contain high propellant pressure. This portion of the gun system may therefore be relatively light.

Figure 2F:
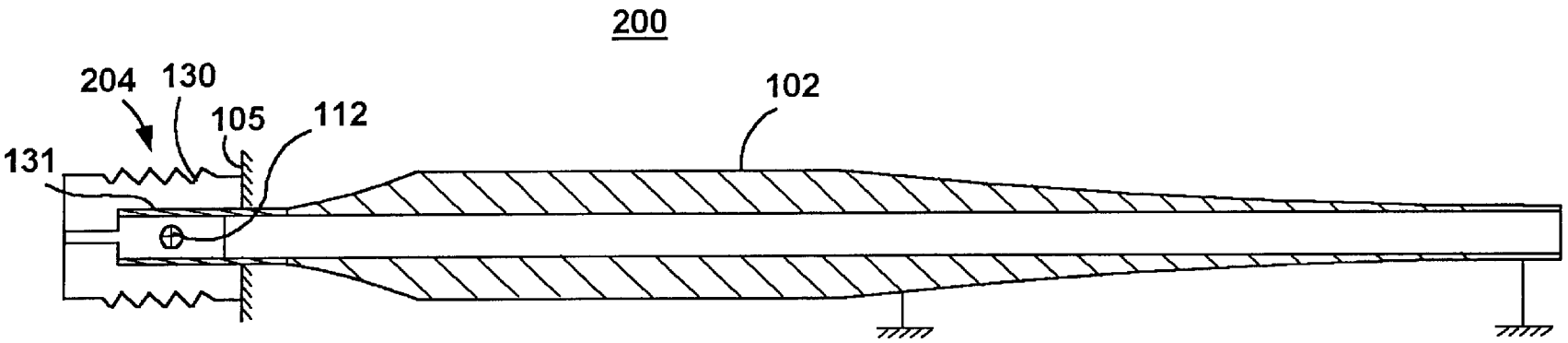

FIG. 2F illustrates the state of the gun system 200 after the shot exit, during the containment of the recoiling breechblock 112. Through proper design and conservation of energy, the kinetic energy of the breechblock 112 following the shot exit is converted into the potential energy of the recoil system springs 130. Just enough energy is stored to fire the next round, after it is loaded. It is worthwhile to note that no dissipation of energy (by means of the brakes 125) is required for this system.

FIGS. 3A through 3F illustrate the operation of a dual recoil inertial breechblock gun system 300 during breechblock fire out of battery launch. The gun system 300 includes a recoiling gun barrel 302. The barrel 302 begins to move rearward as soon as the inertial breechblock 112 is released and pre-accelerated forward.

Figure 3A:
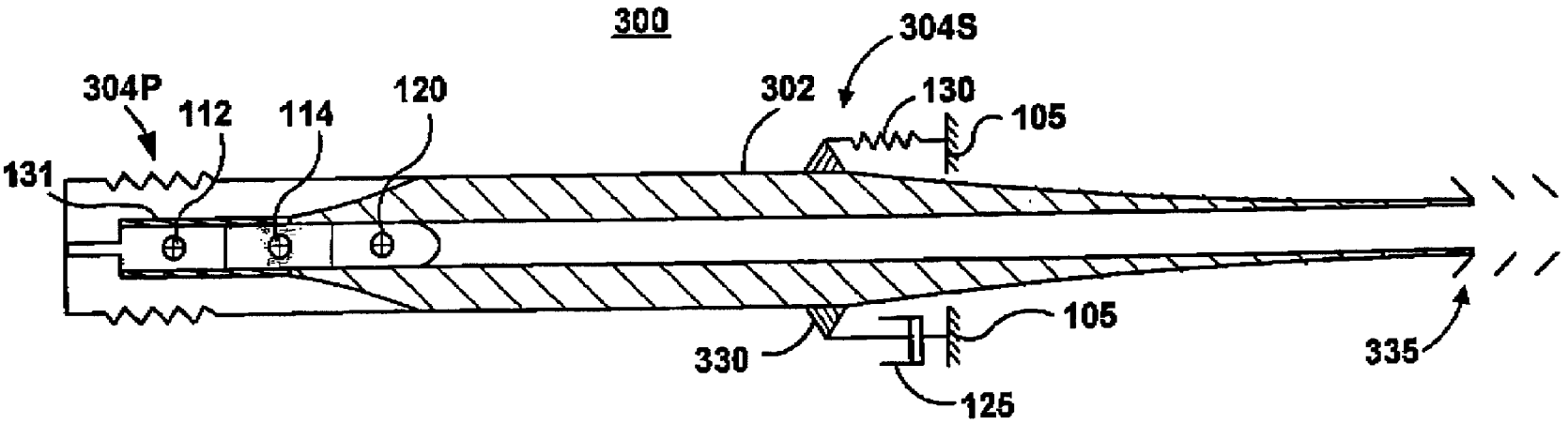
FIGS. 3A, B, C, D, E and F are schematic, cross-sectional, side elevational view of a dual recoil inertial breechblock gun system of the present invention, illustrating its operation during breechblock fire out of battery launch.

FIG. 3A illustrates the gun system 300 prior to firing. The load between the barrel 302 and the inertial breechblock 112 is decoupled from the weapon platform by a secondary recoil system 304S, the load applied to the breechblock 112 may be very high.

Although the recoiling gun barrel 302 bears some similarity to the non-recoiling barrel 102 of FIGS. 1A through 1D and 2A through 2F in regard to its pressure containment requirements, the gun barrel 302 recoils somewhat like a conventional gun barrel. As depicted in FIGS. 1A through 1F, the gun system 300 is coupled to a gun mount/platform 105. The secondary recoil system 304S is attached to the gun barrel attachment points 330 at this location. Also, the recoiling gun barrel 302 is shown with a muzzle brake 335 which is designed to redirect the flow velocity of some portion of the propellant gases 114 rearward after shot exit. This change in propellant gas momentum results in large forward loads applied to the gun barrel 302 at the muzzle brake 335. These loads require the need for the secondary recoil system 304S to isolate this shock load from the gun platform.

The secondary recoil system 304S negates the kinetic energy of the gun barrel 302 using both stored potential energy and energy dissipated by the application of recoil brakes 125. It is important to note that since the inertial breechblock 112 is decoupled from the weapon platform 105, very large loads may be applied by the primary recoil system 304P. This will enable dramatically lighter inertial breechblocks 112.

This gun system 300 enables some of the positive fire out of battery capability while using both the muzzle brakes and cannon barrel mass to reduce the energy that is ultimately transferred to the platform (i.e., the tank hull). The light inertial breechblock requires significant forward velocity to achieve the fire out of battery momentum. Thus substantial "wasted energy" is imparted by the highly preloaded and soft spring. Part of this energy becomes manifest as increased projectile energy at shot exit. Upon firing, the breechblock velocity is reversed with substantial speed. The kinetic energy of the recoiling breechblock is then once again stored in the recoil springs. In essence, energy lost by the interior ballistics to the recoiling inertial breechblock is saved and placed into the projectile of the next round. Most of the energy is therefore recycled.

The muzzle brake 335 is common to many conventional gun systems, and partially redirects the forward momentum of the propellant gases 114 rearward. This momentum reversal actually reduces the net momentum imparted to the integrated gun, system 300 and its launch platform 105. The abrupt and substantial loading of the muzzle brakes 125 necessitates the shock isolation provided for by the secondary recoil system 304S.

Figure 3B:
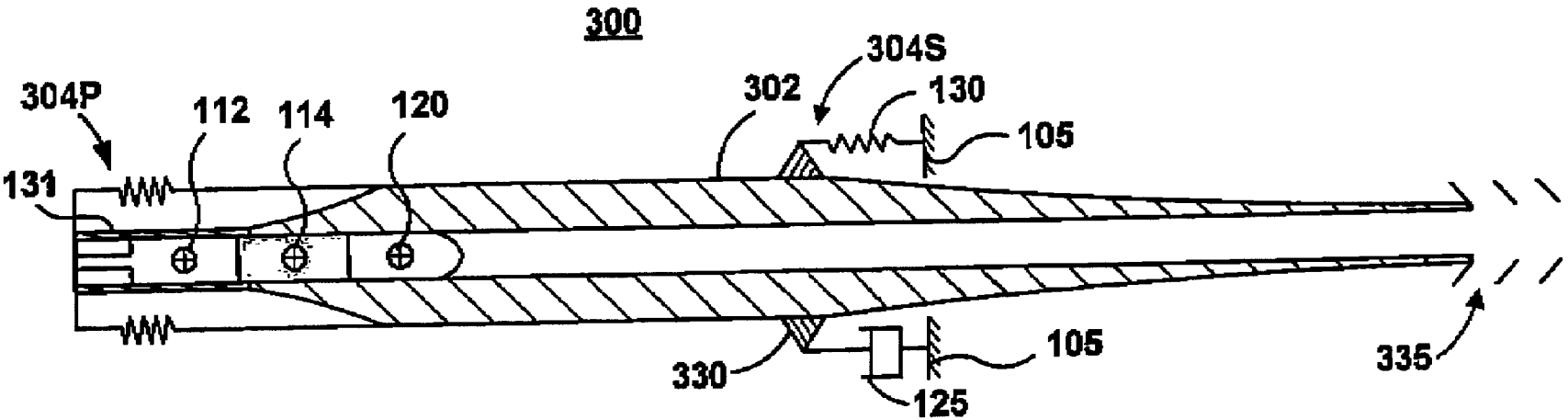

With reference to FIG. 3B, roughly half of the barrel (302) recoil deflection will occur by the time the projectile 120 is fired. The operation steps of the gun system 300 shown in FIGS. 3C through 3E that follow ignition occur in very quick succession, nominally 10 msec for a conventional 120 mm cannon launched kinetic energy projectile 120. Since these operation steps occur very quickly, and because the barrel 302 is isolated from the inertial breechblock containment, the barrel 302 recoils very little during these events, and the velocity of recoil of the barrel 302 changes very little until the muzzle brake 335 is activated, as shown in FIGS. 3D and 3E, where it attains appreciable forward momentum to cancel, in whole or in part, the rearward momentum that it attained prior to the activation of the muzzle brake 335.

Figure 3C:
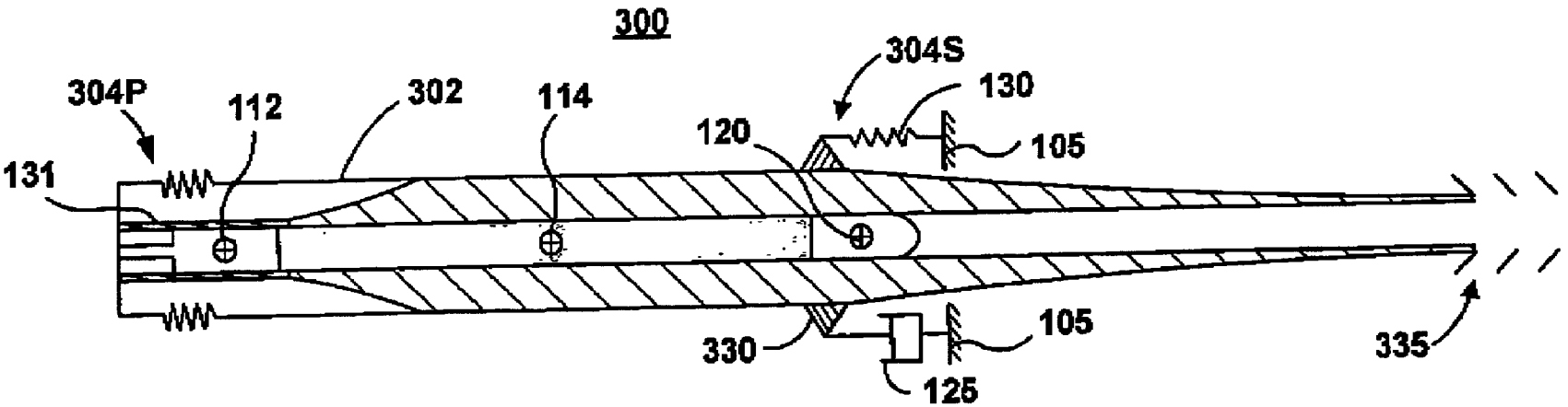
Figure 3D:
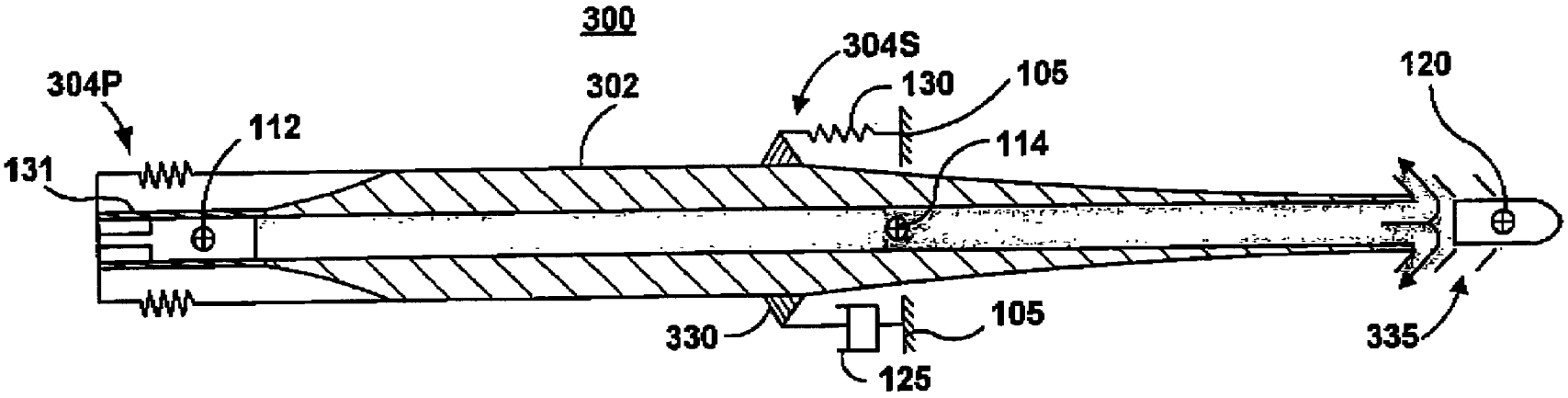
Figure 3E:
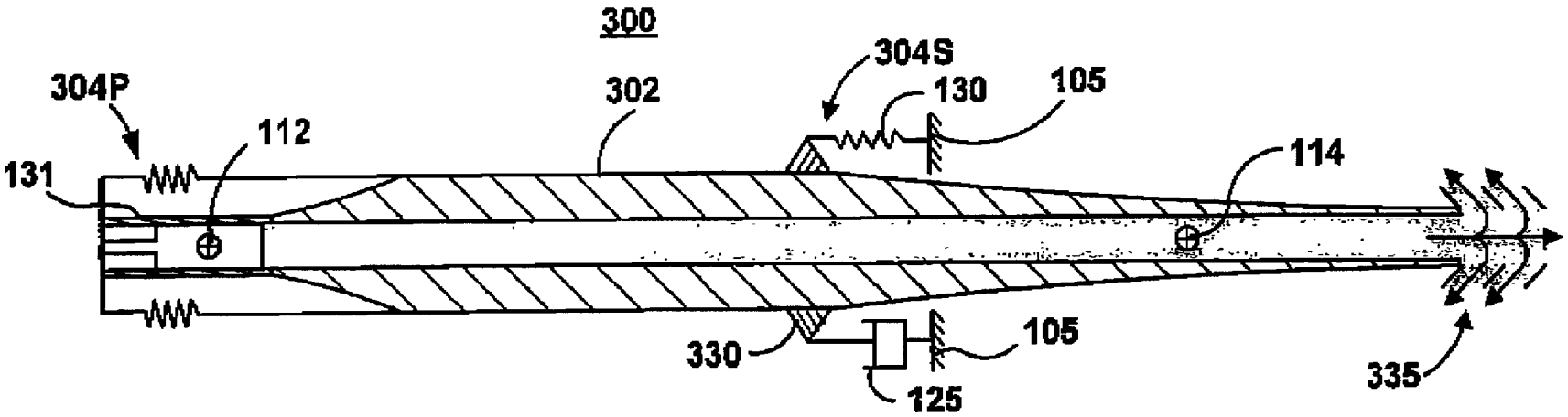

It is during the operation steps illustrated in FIGS. 3C and 3D that the rearward momentum is applied to the inertial breechblock 112 to balance the forward momentum of the projectile 120 and propellant gases 114. During the operation steps illustrated in FIGS. 3D and 3E, the muzzle brake 335 is activated and some of the forward momentum of the propellant gases 114 is deflected rearward, thus applying a forward load to the gun barrel 302 and not the inertial breechblock 112.

During the operation step illustrated in FIG. 3D, after the "blow down" of the propellant gases 114 is complete, the rearward momentum of the inertial breechblock 112 is applied to the recoiling gun barrel 302, while the kinetic energy of the inertial breechblock 112 is stored in the potential energy of primary recoil springs 304S. This energy will be applied to pre-accelerate the projectile 120 and the breechblock 112 for the next launch. The kinetic energy applied to the recoiling gun barrel 302 is stored in part in the secondary recoil springs 130 with the remainder dissipated by the recoil brakes 125. The energy stored in the secondary recoil springs 130 will be applied to move the gun barrel 302 back to its battery position as depicted in FIG. 3A.

Figure 3F:
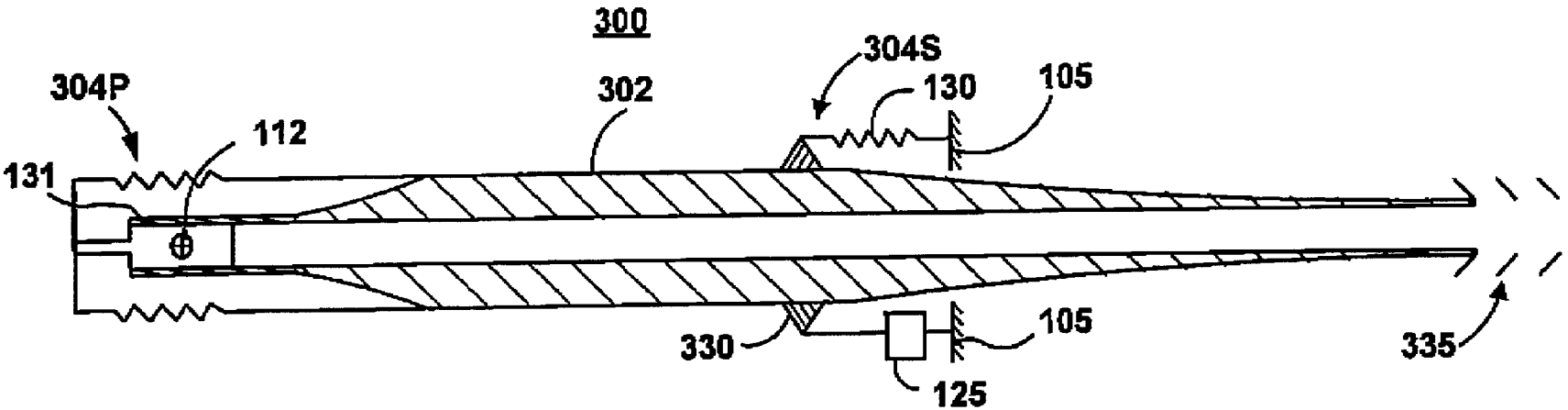

FIG. 3F illustrates the gun system 300 after the shot exit, during the containment of the recoiling gun barrel, with the gun barrel at its furthest extent of recoil.

Fire out of battery is enabled because misfire rounds do not result in a sharp momentum exchange between the gun system 200, 300 and the weapon platform 105. Fire out of battery enhances recoil load versus time profiles by achieving momentum balance with the outgoing projectile or round 120 and propellant gases 114 over a greater duration of time. This is done by initiating the loads prior to firing the round 120. A related benefit is that the velocity of the recoiling mass is reduced by the velocity that it attained at shot ignition. Since kinetic energy is a function of velocity squared, the potential exists to cut the kinetic energy requirements by a factor of four if the initial velocity were exactly opposite to the velocity immediately following launch. This kinetic energy equals the integral of the recoil load over the recoil stroke, so that load reductions by a factor of four are theoretically possible. Momentum would be conserved by the application of these reduced loads over an increased time interval such that the integral of recoil force over time still equals the launch momentum.

Using a conventional gun system the entire gun barrel 302 and breechblock system are pre-accelerated forward. If a round 120 does not fire when anticipated, this forward momentum must be extracted from the gun system 300 and applied to the mount platform 105. Since the recoil stoke displacement is a precious commodity, little deflection is available for this momentum exchange to occur and it will result in the application of large transient loads that may damage the gun system or violently shift the platform position. Because of this propensity for damage in the event of misfire, much of the precious recoil stroke is dedicated to a snubber design for this malfunction. The result is that less recoil stroke is available for normal operation, and greater recoil system loads are required to achieve the kinetic energy associated with the desired forward momentum of the gun system; thus reducing the motivation for fire out of battery in the first place.

The inertial breechblock gun system 300 has the advantage that the entire bore length of the gun barrel 302 is available to slow the forward momentum of the inertial breechblock 112 and round 120. Thus, the stroke length that was intended for launch travel may be used by the recoil system in the event of a misfire. Because the entire, bore length is available, recoil system load versus time (i.e., momentum) and load versus position (i.e., energy) profiles that follow in complete analogy with the pre-acceleration profiles may be employed. The force would be reversed in sign, and the deflection would extend beyond the intended launch position by the pre-acceleration stroke length.

Hang-fire rounds, that is misfired rounds that fire after the misfire snubber stop the forward momentum of the gun system may be addressed using the present invention. A conventional gun system requires a recoil system designed for fire in battery operation. That is, if a misfired round subsequently fires, the momentum exchange will result in rearward velocities of the recoiling gun system as high as twice the speed of the fire out of battery mode of operation. Thus, up to four times the fire out of battery recoil load will have to be applied to negate the increased kinetic energy over the same recoil stroke. Since most gun systems are designed for maximum recoil loads, this often requires a recoil stroke as much as four times as long as the fire out of battery requirement.

The present invention handles hang-fire two ways. First, as stated earlier, misfires may be ejected out of the muzzle of the gun barrel. Second, since a misfire is a precondition for a hang-fire, the misfire handling as described above may intentionally consume the required bore stroke to safely control the higher rearward momentum of a hang fire. A hang fire may require as much as four times the recoil stroke intended for a fire out of battery launch. If the misfire is slowed with sufficiently small applied recoil loads, it may travel down the bore of the gun barrel by a distance equal to three times the intended recoil stroke, which already exists, thus adding up to the stroke length required for safe operation. A hang-fire that is launched will have sacrificed launch travel for the recoil stroke, and thus will launch with reduced velocity and momentum.

To be more precise, the miss-fire recoil handling system could apply a recoil load profile engineered such that at every instant in time, the available recoil stroke is sufficient to handle the momentum exchange of a hang-fire. Thus, the misfire recoil system is designed to address the recoil needs of the gun system if the round were to ignite at any time following the intended firing position, taking into account the remaining forward momentum of the inertial breechblock if any. When the round comes to rest, it may be ejected at any time out of the muzzle.

It should be apparent that many modifications may be made to the invention without departing from the spirit and scope of the invention. Therefore, the drawings, and description relating to the use of the invention are presented only for the purposes of illustration and direction.

For example, an electromagnetic launch mechanism can be used with the gun systems of the present invention. As an example, a railgun launcher can be used where the sliding breechblock serves as a sliding rear armature to conduct the electrical current from the pulsed power supply to the rails. Thus, the electromagnetic load would be inertially contained.

Adaptive and controlled recoil systems can also be used in conjunction with the present invention. This alternative embodiment will achieve the designed recoil load versus velocity and displacement. This embodiment includes one or more of the following components:

(1) pneumatic springs that may undergo significant compression ratio and pressure adaptations to tune the performance of the recoil system to meet the needs of individual rounds.

(2) Electromagnetic actuators to store potential energy using electrical or magnetic fields as opposed to the strain energy of mechanical springs. Such devices, for example a fly wheel storage device, may also store energy in a mechanical form for convenient conversion to electrical power.

(3) Feedback controlled recoil systems that adjust operational loads during recoil to account for variation in system parameters, initial conditions, and disturbance loads.

(4) Adaptive or controlled brake actuators such as electro-rheological or magneto-rheological fluids, adaptive orifices, and some electromagnetic devices etc. These devices share the property that they may only apply recoil loads in directions that oppose relative velocity and dissipate the vast majority of the kinetic energy extracted.

Pyrotechnic devices can be added to the gun systems of the present invention to achieve forward momentum of the inertial breechblock in fire out of battery mode.

What is claimed is:

1. A gun system using a propellant and a projectile with no cartridge case, comprising:

a barrel that includes a muzzle brake, wherein the barrel is subject to recoil motion only after the projectile passage through the muzzle brake;

a recoil system secured to said barrel and including a spring, at least one end of said spring being secured to a mount fixture;

an inertial breechblock housed within said barrel, and capable of translating within said barrel while the projectile is being propelled within said barrel under the action of ignited propellant, that provides a sliding seal which seals propellant gas pressure as the breechblock is propelled rearward under the action of the ignited propellant;

said breechblock enabling the loading of the propellant and the projectile within said barrel by opening and closing a chamber, and further enabling pressure to be contained within said barrel during firing;

said breechblock enabling pressure to be contained within said barrel during firing, primarily by inertial resistance to motion; and said recoil system applying a load to said breechblock and said load being a function of the breechblock position and velocity within said barrel.

2. A gun system according to claim 1, wherein said recoil system includes a primary recoil system and a secondary recoil system.

3. A gun system according to claim 2, wherein prior to firing, a load between said barrel and said breechblock is decoupled from a mount fixture by said secondary recoil system.

4. A gun system according to claim 3, wherein the gun system further includes the muzzle brake; and wherein said muzzle brake redirects a flow velocity of a portion of propellant gases rearward after shot exit, which results in a large forward load applied to said barrel at said muzzle brake.

* * * * *